US005301845A

United States Patent [19]

Labonte

[11] Patent Number: 5,301,845

[45] Date of Patent: Apr. 12, 1994

[54] LIQUID MEASURING AND DISPENSING CONTAINER

[76] Inventor: Jean-Pierre Labonte, 20 Debonnair Street, Courville, Canada, G1C 5L7

[21] Appl. No.: 968,423

[22] Filed: Oct. 29, 1992

[51] Int. Cl.[5] ..... B65D 37/00

[52] U.S. Cl. ..... 222/211; 222/213

[58] Field of Search ..... 222/207, 211, 213, 158, 222/464, 494

[56] References Cited

U.S. PATENT DOCUMENTS

| | | | |
|---|---|---|---|
| 2,752,199 | 6/1956 | Newell | 222/211 |
| 2,854,175 | 9/1958 | Spitzmesser | 222/211 |
| 3,168,913 | 2/1965 | Eagles | 222/158 |
| 3,176,883 | 4/1965 | Davis | 222/211 |
| 3,221,945 | 12/1965 | Davis | 222/211 |
| 4,286,735 | 9/1981 | Sneider | 222/464 |
| 4,513,891 | 4/1985 | Hain et al. | 222/213 |
| 4,557,401 | 12/1985 | Hodge | 222/211 |

*Primary Examiner*—Andres Kashnikow
*Assistant Examiner*—Philippe Derakshani
*Attorney, Agent, or Firm*—Pierre Lespéance; Francois Martineau

[57] ABSTRACT

A squeeze container has a flexible and resilient sidewall and a top mouth closed by a cap through which a measuring tube extends into the container to terminate adjacent the container bottom wal. A normally-closed check valve is fitted to the tube bottom end to allow liquid in the container to enter the tube in a measured quantity when the side wall is squeezed and for retaining the measured quantity of liquid when the tube sidewall is released. The measured liquid in the tube is discharged when the container is inverted and squeezed. After liquid discharge, outside air is admitted within the container to nearly re-establish atmospheric pressure, either through the measuring tube or through a check valve located at the cap. In the first case, the measuring tube check valve is not hermetic when closed, so as to permit air entrance at a slow rate. The measuring tube valve may simply be a stretchable membrane fitted across the tube lower end and having through openings which open only when the membrane is stretched. The cap valve may be in the form of an annular membrane sealed to the container top mouth around its periphery and having a sliding fit with and around the tube. Outside air can enter the container between the membrane and the tube when the container is under partial vacuum. Instead of a check valve, the cap can be provided with an elastic, fluid-tight membrane which stretches to decrease the differential pressure existing across the same.

5 Claims, 5 Drawing Sheets

15
115
111
117
113

15
115
117
111
113

89
109

89
109

23
9
45
7
1
13

55
57
15
53
47
46a 20a
9
17
19
7
1
13
23
43
41

LIQUID MEASURING AND DISPENSING CONTAINER

FIELD OF THE INVENTION

The present invention relates to a squeeze dispenser and, more particularly, to a dispenser capable of measuring a desired quantity of the liquid in the container and of dispensing the measured liquid when the container is inverted.

BACKGROUND OF THE INVENTION

Various types of liquid-measuring, squeeze containers are known in which the container must be squeezed to displace the liquid into a measuring chamber, and the measured liquid is then discharged. Examples of such dispensers are illustrated in the following U.S. Pat. Nos. 2,989,216 dated Jun. 20, 1961 to Moro-lin., 3,141,579 dated Jul. 21, 1964 to Medlock; 3,878,972 dated Apr. 22, 1975 to Por; and 4,106,673 dated Aug. 15, 1978 to Donoghue. In all these patents, the measuring chamber is mounted on top of the container or at an end of the same and have a relatively large diameter, of the same order as that of the container itself, so that the liquid cannot be measured in a very accurate way. Also, in those dispensers in which the measuring chamber is mounted on the outside of the squeeze container itself, they are liable to be accidentally damaged and their measuring accuracy distorted. Also, one may accidentally discharge the liquid being measured before final measurement in the event of faulty handling of the dispenser.

OBJECTS OF THE INVENTION

The general object of the present invention is to provide a liquid-measuring dispenser, of the squeeze type, which obviates the above-noted disadvantages and, more particularly, in which the liquid can be measured with precision.

Another object of the present invention is to provide a liquid-measuring dispenser of the character described, of simple and inexpensive construction and which is easy and fast to manipulate.

Another object of the invention is to provide a dispenser of the character described, in which the liquid-measuring device is protected from damage.

SUMMARY OF THE INVENTION

The liquid-measuring and dispensing container of the invention comprises a squeeze container, having a flexible and resilient sidewall, a bottom wall and a top mouth, a cap closing the mouth, a measuring tube fixed to and extending through the cap into the container and opening outside the cap at its top end and adjacent the bottom wall at its bottom end, and a measuring tube valve carried by the tube bottom end for allowing liquid in the container to enter the tube into a measurable quantity when the side wall is squeezed and for retaining the measured quantity of liquid in the tube when the side wall is released and returns to its original shape. The measured quantity of liquid is discharged from the top end of the tube when the container is inverted. The tube, being of a small diameter, allows to precisely measure a desired quantity of liquid. The tube has calibration marks which increase in value from bottom to top. The measuring tube valve is a check valve which can close in a hermetic or non-hermetic manner. When a hermetic type check valve is used, a cap valve is also provided, which allows air entrance within the container to nearly re-establish atmospheric pressure after dispensing of a measured amount of liquid. When a non-hermetic check valve is used, air enters the container through the tube and tube check valve to nearly re-establish air atmospheric pressure within the container. Various types of check valve may be used. In a preferred embodiment, such a valve is a flexible, elastic membrane.

DETAILED DESCRIPTION OF THE PREFERRED EMBODIMENTS OF THE INVENTION

Figure 2:
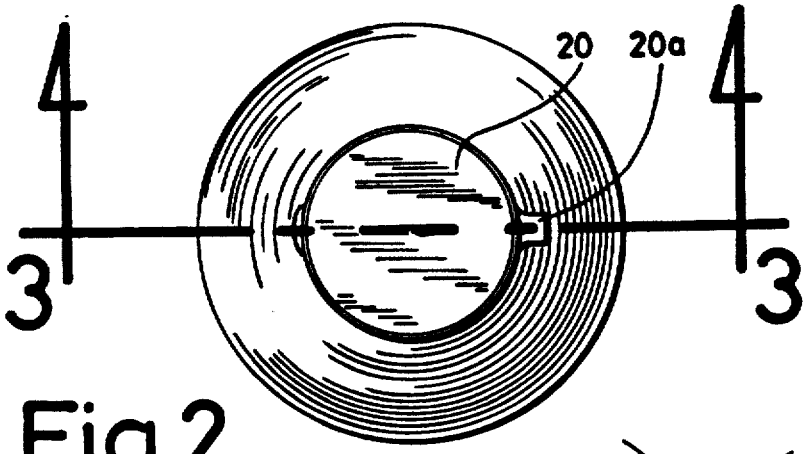
FIG. 2 is a top plan view of the same.
Figure 1:
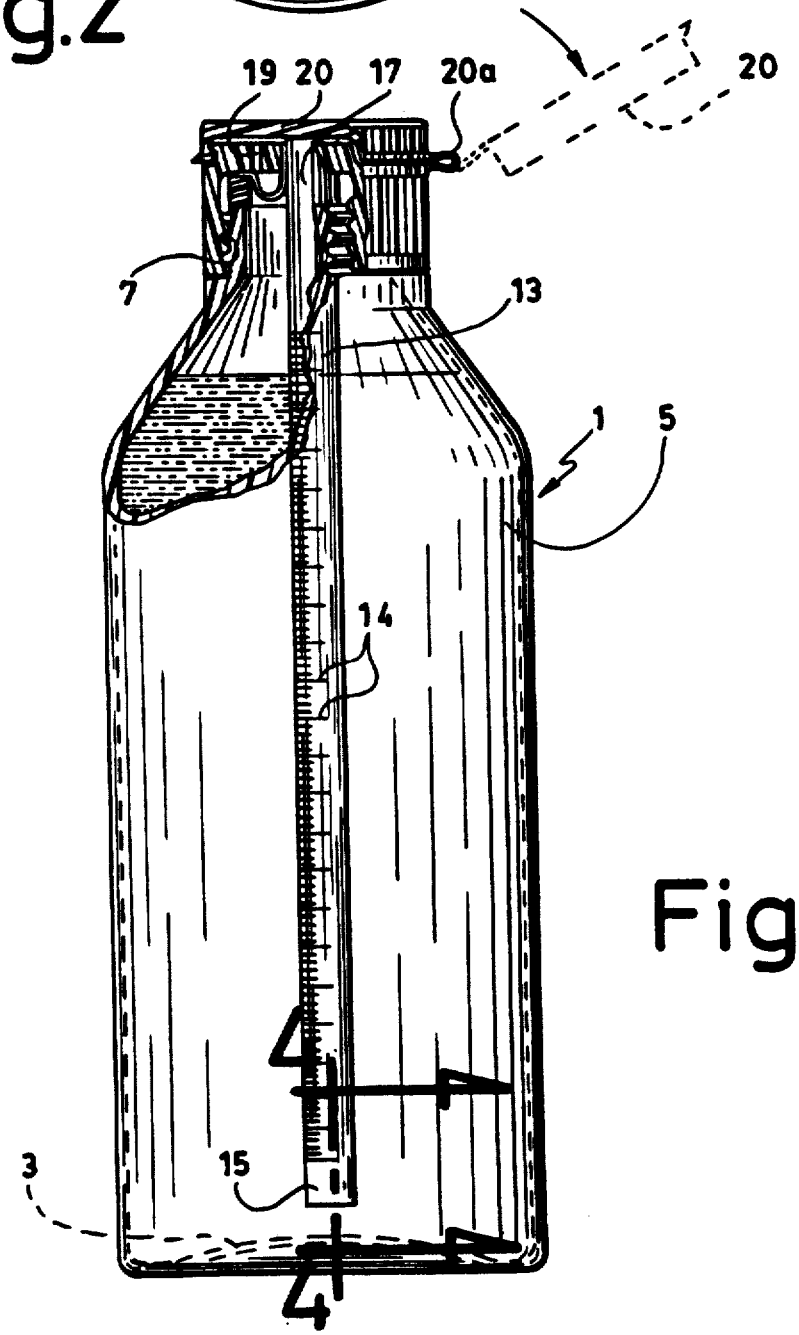
FIG. 1 is a side elevation, partially in longitudinal section, of a liquid-measuring and dispensing container in accordance with the invention.

Referring to FIGS. 1 to 5, there is shown a squeeze container 1, in the form of a bottle, made of flexible and resilient material, such as polyethylene and defining a bottom wall 3, a flexible and resilient side wall 5, and a top mouth 7 on which is removably fitted a threaded cap 9 provided with a through bore 11 into which is secured a measuring tube 13 which extends downwardly into the container 1; the tube bottom end 15 is disposed just above the bottom wall 3. The top open end 17 of the measuring tube 13 slightly protrudes from the cap 9. As an alternative, the tube top end 17 could be fixed to the underside of cap 9 and in communication with a discharge opening made through cap 9. Referring to FIG. 1, it is seen that the measuring tube 13 is provided with a graduation, indicated at 14, with calibration markings, for instance in milliliters, and increasing in value from bottom to top of the tube. The tube diameter may vary depending on the desired range of liquid volumes to be measured and dispensed. Obviously, the liquid to be measured and dispensed must be transparent and also the container 1 or at least a window thereof, which would be in register with the tube graduations, so as to permit reading of the latter. If the liquid is to be dispensed in doses, that is in definite quantities, a complete tube filling will be a dose. In this case, the bottle and/or liquid can be opaque and no graduation 14 is required.

Cap 9 has a bleed hole 19 laterally spaced from measuring tube 13 and establishing communication between the exterior of the bottle and the underside of the cap 9. A lid 20 is hinged to cap 9 by an integral link 20*a*; it is snapped into close position to close tube 13 when the container is not used.

Figure 3:
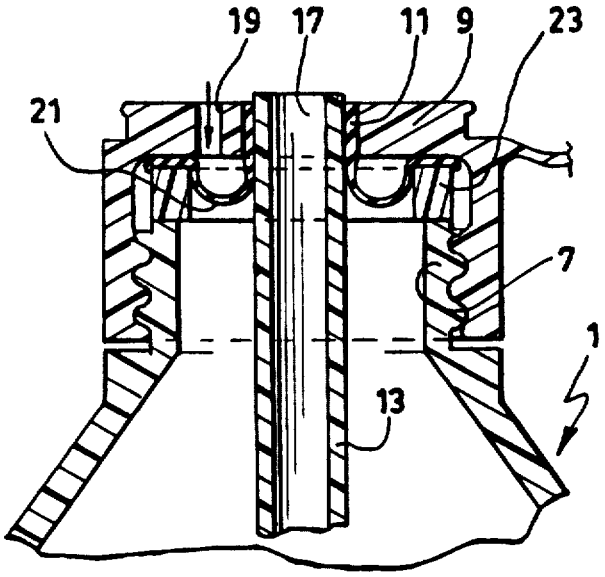
FIG. 3 is a partial longitudinal section of the top portion of the container fitted with a differential pressure-decreasing membrane.
Figure 3A:
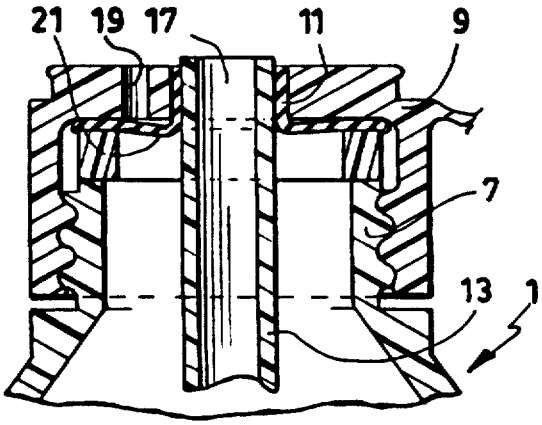
FIGS. 3A and 3B are sections similar to that of FIG. 3, showing the membrane in two other positions.
Figure 3B:
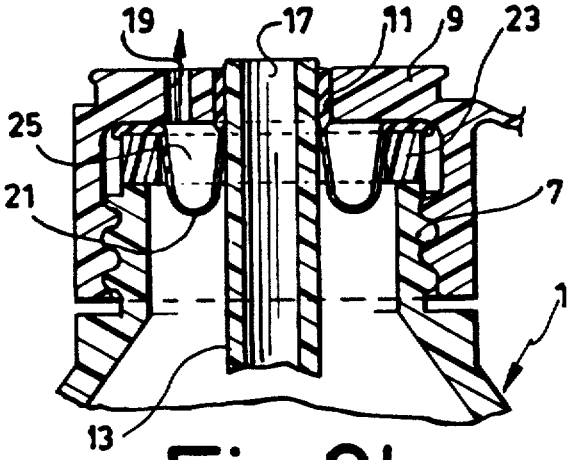

In the embodiment of FIGS. 3 to 3B, the top mouth 7 of the container 1 is provided with a differential pressure-decreasing membrane 21, of fluid-proof, elastic and flexible material, such as natural or synthetic rubber, which is annular in shape, its outer periphery being sandwiched between the underside of cap 9 and a rubber washer 23 located on top of the mouth 7 and held tight by the cap 9, which is screwed on the container 1. The tube 13 extends through the hole of membrane 21 and the area of said membrane surrounding said hole is sandwiched between the tube and the through bore 11 of the cap 9. Thus, membrane 21 effects a fluid-tight closure between the inside of the container 1 and the underside of cap 9. Therefore, an air chamber 25, formed between the top surface of membrane 21 and the cap 9, is in communication with the exterior through bleed hole 19, but is sealed from the inside of the container. The purpose of this membrane 21 will be described hereinafter.

In some embodiments, membrane 21 and bleed hole 19 are totally dispensed with, the cap 9 without the bleed hoe 19 forming a fluidtight closure for the container 1. The measuring tube 13 is also carried in fluid-tight manner by the cap 9. This arrangement is used when outside air is admitted into the container through the measuring tube 13 to nearly re-establish atmospheric pressure above the liquid after a liquid-dispensing operation.

Tube 13 is secured in fluid-tight relation with cap 9 by the use of, for instance, a rubber bushing 27 (see FIG. 9), which surrounds the tube 13 and is tightly inserted within through bore 11 around measuring tube 13.

After a liquid-dispensing operation, air can enter into the bottle directly on top of the liquid when the container is upright through a cap check valve. A first embodiment of such a cap check valve is shown at 29 in FIG. 9, wherein cap 9*a* has a bleed hole which forms a valve seat 31 facing towards the inside of the container 1. A valve member, in the form of a ball 33, is held against the valve seat 31 by means of a compression spring 35, which extends between and presses against the ball 33 and a perforated lid 37 closing the valve bore 29. Whenever partial vacuum exists on top of the liquid in the upright container 1, valve 29 opens to admit outside air inside the container and, thus, re-establish nearly atmospheric pressure, depending on the force exerted by the spring 35. When the bottle is compressed, the compressed air on top of the liquid cannot escape through valve 29.

Figures 9, 10, 11, 11A, 12, 12A, 13, 14, 14A:
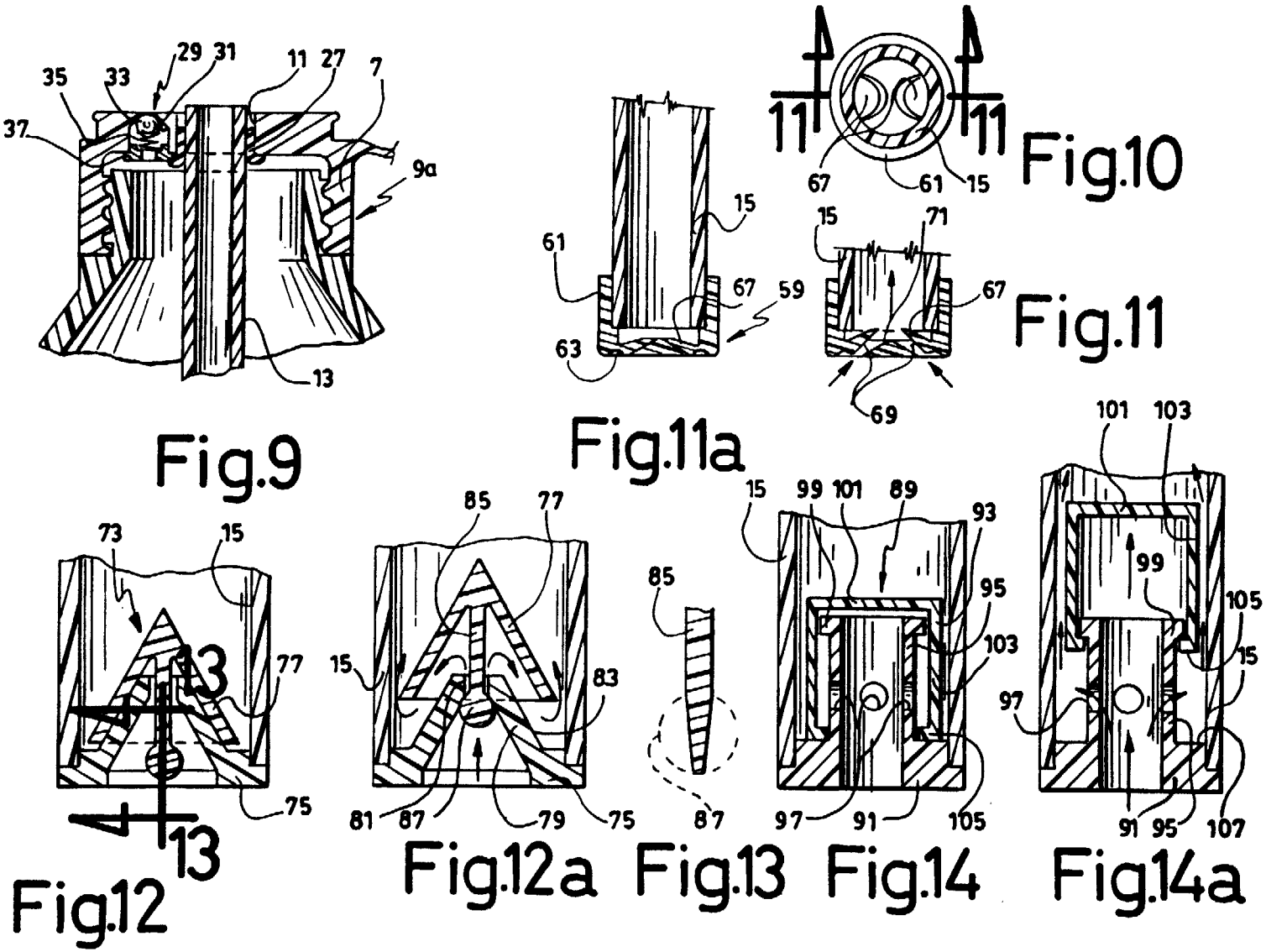
FIG. 9 is a partial longitudinal section of the top of the container fitted with a first embodiment of the cap check valve.
FIG. 10 is a plan section of the lower end of the tube provided with another embodiment of the tube check valve.
FIG. 11 is a partial longitudinal section, taken along line 11—11 of FIG. 10.
FIG. 11A is a view similar to that of FIG. 11, but showing the valve in closed position.
FIGS. 12 and 12A show still another embodiment of the measuring tube check valve in closed and open position, respectively.
FIG. 13 is a partial section taken along line 13—13 of FIG. 12.
FIGS. 14 and **14*a* are views similar to that of FIG. 11**, but showing Yet another embodiment of the measuring tube check valve in closed and open position, respectively.
Figures 4A, 15, 15A, 16, 16A, 17, 17A:
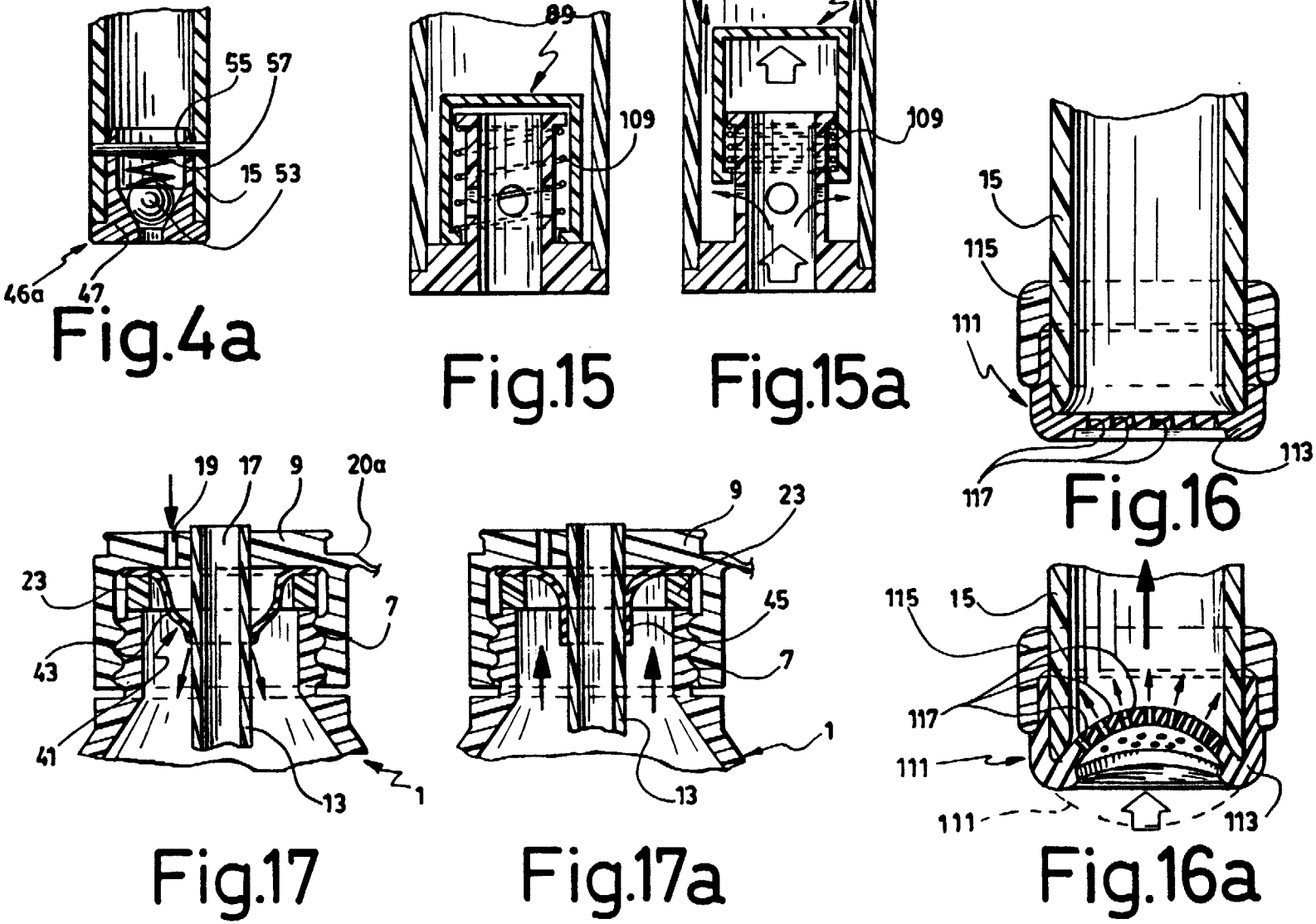
FIG. 4A, shown on the fifth sheet of drawings, is a view similar to that of FIG. 4 showing the same check valve but provided with a spring.
FIGS. 15 and 15A are views similar to FIGS. 14 and 14A, respectively, showing the same valve fitted with a compression spring.
FIG. 16 and 16A show , in longitudinal section the lower end of the measuring tube fitted with a membrane type check valve in closed and o en position, respectively.
FIGS. 17 and 17A are views similar to that of FIG. 3, but showing another embodiment of the cap check valve in closed and open position, respectively.

The cap check valve 29 of FIG. 9 can be replaced by a membrane type check valve 41, shown in FIGS. 17 and 17A. The cap 9, with its bleed hole 19, as shown in FIG. 3, is used together with the rubber washer 23. The measuring tube 13 is tightly fitted in fluid-tight manner within the through bore 11 of cap 9. A flexible and stretchable or elastic, impervious membrane 43, similar to membrane 21, is sandwiched in fluid-tight manner at its periphery between the rubber washer 23 and the underside of cap 9, but its radially-inner portion 45 immediately surrounding the central hole in the membrane has a friction-fit around the tube 13 and downwardly extends along said tube. When there exists a partial vacuum over the liquid of the upright container 1, pressure restoring outside air enters bleed hole 19 and causes expansion of membrane portion 45, whereby the air enters the container between the membrane portion 45 and the tube 13. When there is overpressure over the liquid of the upright container, as when the container is sgueezed membrane portion 45 is pressed in fluid-tight engagement around tube 13 and no air can escape to the outside.

In accordance with the invention, the bottom end 15 of the measuring tube 13 must be provided with a check valve, namely: a measuring tube check valve Various embodiments of such a check valve are now described and illustrated.

Figure 4:
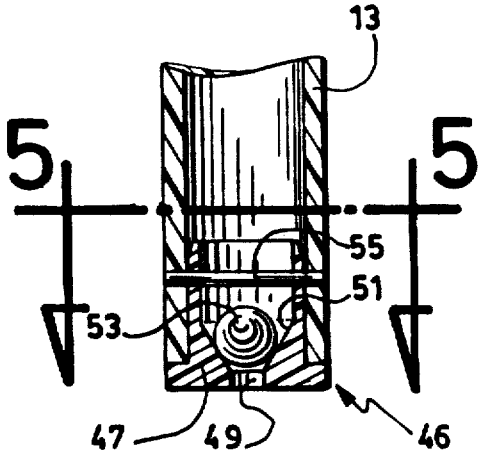
FIG. 4 is a partial longitudinal section of the lower end of the measuring tube, provided with one embodiment of a measuring tube check valve.
Figure 5:
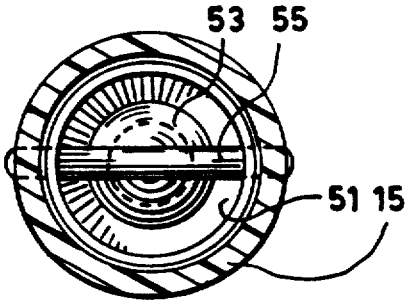
FIG. 5 is plan section taken along line 5—5 of FIG. 4.

FIGS. 4 and 5 show a gravity type check valve including a valve body 47 frictionally fitted to the bottom end 15 of measuring tube 13 and defining a central through bore 49, with an upwardly-directed, inverted, frusto-conical valve seat 51 on which rests by gravity a ball 53, which is the valve member. Upward movement of the ball 53 is limited by a rod 55 extending across the valve body 47 and the tube 13. Rod 55 also serves to secure valve body 47 within the tube 30. Check valve 46 opens to allow liquid from the container into the measuring tube 13 when the container 1 is squeezed, and closes when the container is released and returns to its original shape due to the resiliency of its sidewall 5. This is accomplished when the bottle is in upright position.

FIG. 4A shows a check valve 46A, which is identical to check valve 46 of FIG. 4, except for the addition of a compression coil spring 57 extending between and pressed against the rod 55 and the ball 53 and maintaining the latter in valve-closing position contacting seat 51, even if the container is in inverted position.

FIGS. 10 to 11A show another embodiment of the measuring tube check valve. This valve 59 is in one-piece construction, defining a cup made of flexible, resilient material and including a skirt 61 tightly fitted over the lower end 15 of the measuring tube 13 and its wall 63 extending across the tube open end. The wall 63 has two openings 65 each obtained by the stamping of a partial cutout 67 extending over the respective opening 65 and depending from a portion of the wall 63. Each cutout 67 has a peripheral edge 69, which mates with the edge 71 of the opening 65. Each cutout 67 is biased into contact with the opening edge 71. Thus, each cutout 67 constitutes the valve member, while the opening edge 71 constitutes the valve seat. The two cutouts 67 are preferably inwardly, upwardly inclined, converging one towards the other, so as to facilitate valve-closing.

FIGS. 12 to 13 show yet another embodiment of the measuring type check valve. This check valve 13 includes a valve body 75 and a valve member 77 Valve body 75 is secured across the lower end of the measuring tube 13 and defines an upstanding conical wall 79, having a perforated apex 81, which communicates the tube 13 with the inside of the container 1. The upper conical surface 83 of conical wall 79 forms a valve seat, this valve seat surrounding perforated apex 81. The valve member 77 is in the form of a cone located over the conical wall 79 and resting on the upper conical surface 83 when in a lowermost position, so as to close the valve.

A stem 85 depends from the apex of the conical valve member 77 and extends through and is guided by the perforated apex 81 and is terminated at its lower end by an enlargement 87, which limits the upward movement of the valve member 77 upon engagement with the lower surface of the conical wall 79 around and adjacent the perforated apex 81.

Another embodiment of the measuring tube check valve is shown in FIG. 14 and 14A. This check valve 89 includes a valve body 91 and a valve member 93, movable between valve-closing and valve-opening position. Valve body 91 is secured across the lower open end of the measuring tube 13 and defines a central upstanding nipple 95, which extends partially within measuring tube 13 and which is open at its bottom end, while its top end may be open or closed.

Nipple 95 has a lateral bore 97 for establishing communication between the container and the inside of the tube. The upper end of the nipple 97 has a peripheral external flange 99, namely a nipple flange. The valve member 93 constitutes an inverted cup defining a crosswall 101 located over the nipple 95 and a depending skirt 103 freely surrounding the nipple 95 and terminated by an internal annular flange 105, namely a skirt flange. The upper surface of valve body 91 surrounding nipple 95 forms a valve seat 107 on which rests the skirt flange 105 in the valve-closing lowermost position of the valve body 93. In this position, the lateral bore 97 is completely covered by the cup-shaped valve body 91 and is out of communication with the inside of the tube. Upward opening movement of the valve body 91 is limited since skirt flange 105 abuts against nipple flange 99, as shown in FIG. 14A. In this position, liquid from the container can enter the measuring tube through the bores 97 and around the valve body 91. The valve illustrated in FIGS. 14 and 44A is of the gravity type, but it can be biased into closed position by the addition of a compression coil spring 109, which, as illustrated in FIGS. 15 and 15A, surrounds the nipple 95 and bears against the nipple flange 99 and skirt flange 105. Similarly, the check valve 73 of FIGS. 12 and 12A is of the gravity type, but could be provided with a valve-closing compression spring, not shown, which would surround stem 85 and bear against the underside of the conical wall 79 and on top of the enlargement 87.

FIGS. 16 and 16A show still another measuring-tube check valve in closed and open position, respectively. This valve 111 comprises a cup-shaped flexible and elastic membrane 113 fitted over and held taut across the lower end of the measuring tube 13 by means, for instance, of a tight-fitted collar 115 surrounding the upper portion of the membrane 113 and the tube end 15. The central portion of the membrane 113 is provided with a plurality of through bores 117 which are closed when the membrane is unstretched but which open, as shown in FIG. 16A, when the membrane is upwardly downwardly curved and stretched under the action of a differential pressure across said membrane.

It will be understood that, when the bottle is in upright position and squeezed, the overpressure in the bottle will cause upward stretching of the membrane 113, as illustrated in full line in FIG. 16A, to permit liquid entrance within the tube. When the bottle is released, the membrane 113 will take the closed position shown in FIG. 16. If a partial vacuum exists within the upright bottle after discharge of the liquid within the tube, air from the outside can enter through the tube and the through bores 113, the membrane taking the dotted line-position of FIG. 16A.

It should be noted that the measuring tube check valve in accordance with the embodiments of FIGS. 4, 4A, and 12, 14, 15 may be hermetically or non-hermetically closed. In the latter condition, small passages exist in the valve seat between the same and the closed valve member to let air or fluid passage at a very slow rate.

Figure 8:
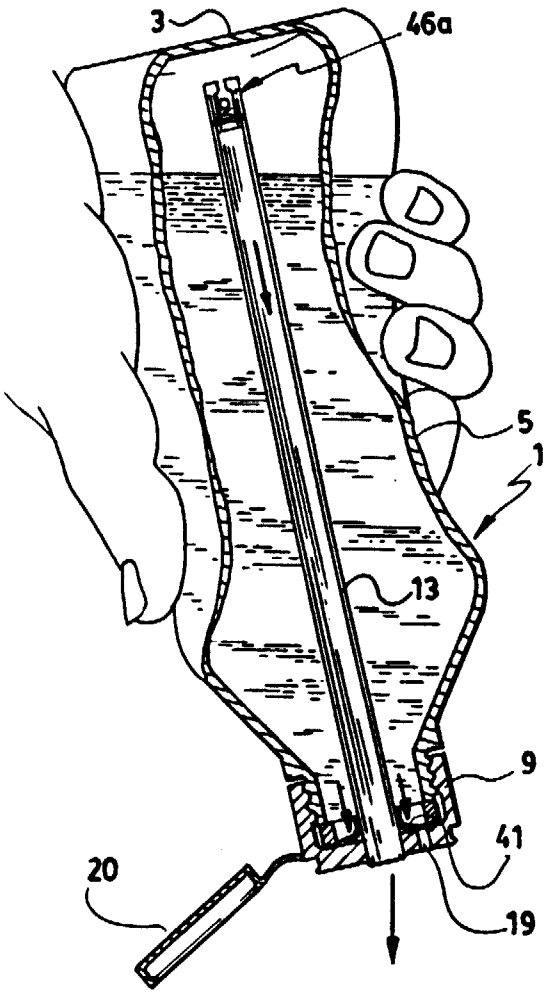
FIGS. 7 and 8 show the container in partial longitudinal section, being handled to measure and discharge liquid.
Figure 7:
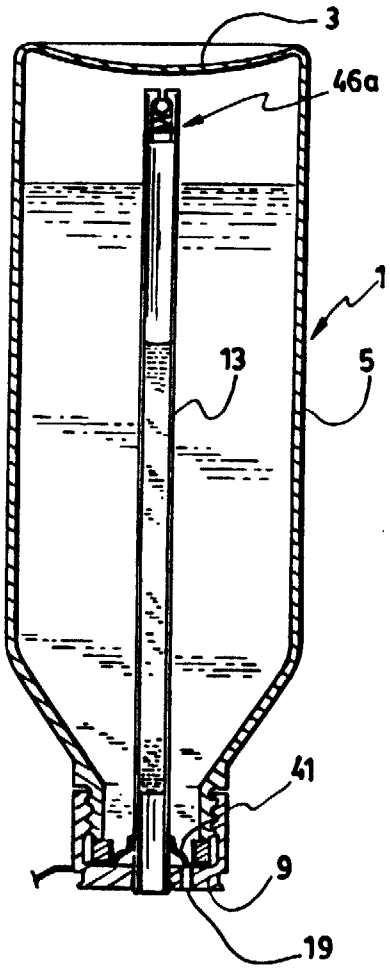
Figure 6:
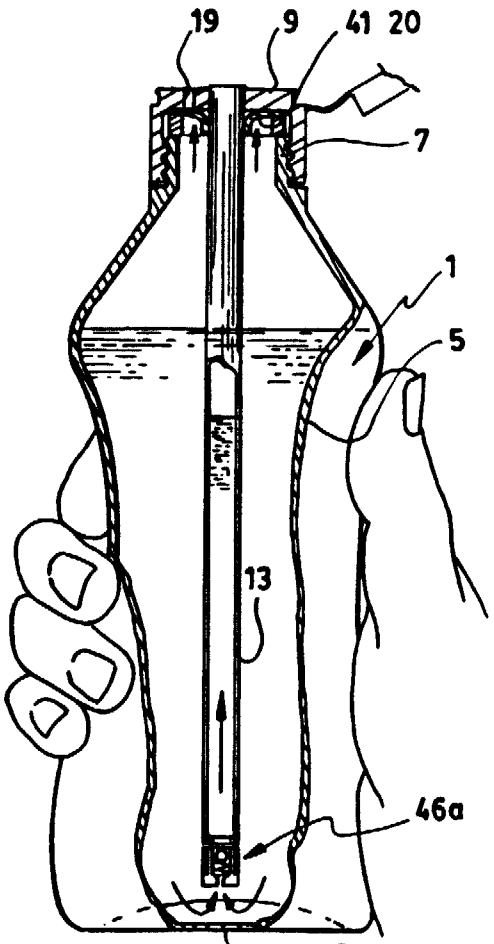

The liquid-measuring and dispensing apparatus of the invention operates as follows:

Reference is made to FIGS. 6, 7, and 8, wherein the container 1 is fitted with the check valve 41, illustrated in FIG. 17, and with the measuring tube check valve 46A, illustrated in FIG. 4A. The bottle in upright and released condition is squeezed by the operator's hand, as shown in FIG. 6, so as to cause overpressure over the liquid and, consequently, filling of the measuring tube 13, valve 46-A then being in open position, until the desired quantity of liquid is measured in the tube by the reading of the graduations 14. Upon release of the container 1, its sidewall springs back to its original shape and valve 46A closes, there being a partial vacuum produced above the liquid. The bottle is then inverted, as shown in FIG. 7. Valve 46A remains closed under the partial vacuum existing above the liquid level and under the action of the spring 57. Therefore, the liquid within the tube remains in said tube; but, upon squeezing the bottle sidewall, the valve 46A opens and the measured quantity of the liquid in the tube is discharged to the exterior. The container is brought back to upright position and the partial vacuum, which has been produced by liquid removal, is decreased by the admission of outside air through the cap valve 41, as described in relation to FIGS. 17 and 17A. Of course, during initial squeezing of the container, as shown in FIG. 6, valve 41 is closed, so that the overpressure produced above the liquid does not escape to the exterior.

The same operation is obtained, using either one of the cap valves 41 of FIG. 17 and 29 of FIG. 9, in combination with any one of the measuring tube check valves 46A of FIG. 4A, 59 of FIG. 10, 73 of FIG. 12 when spring loaded, 89 of FIG. 15, and 111 of FIG. 16.

The cap check valve can be entirely dispensed with and the air replenishing effected through the measuring tube itself, provided the measuring tube check valve, when closed, allows air to enter the tube and move past the valve and rise as bubbles through the liquid with the bottle upright.

Gravity type measuring tube check valve can also be used, such as the valve 46 of FIG. 4, 73 of FIG. 12 and 89 of FIG. 14. Again, a cap check valve will be required only when these measuring tube valves are of the type which hermetically close. A gravity type measuring tube check Valve can be used, provided the same is denser than the density of the liquid being dispensed and yet light enough so as to be kept in closed position in the inverted position of the container, as shown in FIG. 7, under the partial vacuum existing above the liquid level in said position.

It should be noted that if a measuring tube check valve of the type which leaks when closed is used, it is important that the bottle be inverted and the liquid discharged from the tube immediately after the measuring step, if the above outline procedure is used.

The above described procedure can be modified, using the differential pressure-decreasing membrane 21 of FIG. 3 and the measuring tube check valve membrane 111 of FIG. 16. Supposing membrane 21 is in the position shown in FIG. 3 when the bottle is at rest and upright, the bottle is first squeezed; the liquid enters the tube until the desired quantity has been measured, valve 111 taking the full line position of FIG. 16A. The bottle is inverted while being kept in squeezed condition. The membrane 21 is still in the position of FIG. 3A. The bottle is released; the measuring tube valve 111 closes, as shown in FIG. 16; the bottle is again squeezed and the liquid in the tube is discharged through the top open end of the tube. The bottle is then placed in upright position. Due to the increased vacuum over the liquid, the membrane 21 takes a stretched position, such as shown in FIG. 3B to partially decrease the vacuum inside the bottle. Valve 111 stretches in the opposite direction, whereby air can enter through the tube to restore the air pressure above the liquid. In all embodiments the container or bottle could be stored in inverted position provided the liquid level is below the tube bottom end 15.

I claim:

1. A liquid measuring and dispensing container comprising:

(a) a squeeze container having a flexible and resilient sidewall;

(b) a bottom wall and a top mouth;

(c) a cap closing said mouth;

(d) a measuring tube fixed to said cap and extending into the container and opening outside said cap at its top end and adjacent said bottom wall at its bottom end, said tube marked with a calibration scale which increases in value from said bottom end to said top end;

e) tube valve means carried by said tube bottom end for allowing liquid in said container to enter said tube in a measured quantity when said sidewall is squeezed and for retaining said measured quantity of liquid in said tube when said sidewall is released and returns to its original shape, said measured quantity of liquid capable of being discharged through the top end of said tube when said container is inverted; and f) a cap valve communicating the inside of the container with the exterior, said cap valve opening upon the existence of a partial vacuum within said container when upright and closing when said vacuum ceases, said cap valve being a flexible and elastic membrane located under said cap, fixed and sealed to the periphery of said top mouth and having a central hole receiving said tube, said cap having a bleed hole laterally spaced from said tube and communicating the exterior with the top face of said membrane, said membrane having a sealing fit around said tube when there is no vacuum in said container when upright, and stretching radially away from said tube to leave an air passage between said membrane and said tube when partial vacuum exists in said container when upright.

2. A container as defined in claim 1, wherein said tube valve means includes an elastic stretchable membrane fitted across the lower open end of said tube and taking a taut generally flat condition when not subjected to a pressure differential across the same and a stretched curved condition when subjected to a pressure differential, said membrane having through perforations which are closed in said taut flat condition and which are exposed in said stretched curved condition.

3. A container as defined in claim 1, wherein said tube valve means includes a valve body, in the form of a cup, made of flexible, resilient material and including a skirt fitted over the lower end of said tube and a wall extending across the tube open end, said wall having an opening and a partial cutout extending over said opening and integrally depending from a portion of said wall and having a peripheral edge mating with the edge of said opening, said cutout biased into contact with said opening edge.

4. A liquid measuring and dispensing container comprising:

a) a squeeze container having a flexible and resilient sidewall;

b) a bottom wall and a top mouth;

c) a cap closing said mouth;

d) a measuring tube fixed to said cap and extending into the container and opening outside said cap at its top end and adjacent said bottom wall at its bottom end, said tube marked with a calibration scale which increases in value from said bottom end to said top end;

e) tube valve means carried by said tube bottom end for allowing liquid in said container to enter said tube in a measured quantity when said sidewall is squeezed and for retaining said measured quantity of liquid in said tube when said sidewall is released and returns to its original shape, said measured quantity of liquid capable of being discharged through the top end of said tube when said container is inverted;

f) said cap having a bleed hole, laterally spaced from said tube; and g) a differential pressure-decreasing membrane located under said cap, fixed and sealed to the periphery of said top mouth and having a central hole receiving said tube, said membrane fixed and sealed to said tube at said central hole, said membrane flexible and elastic to stretch within said container when a partial vacuum exists in the latter when upright.

h) wherein said tube valve means includes an elastic stretchable membrane fitted across the lower open end of said tube and taking a taut generally flat condition when not subjected to a pressure differential across the same and a stretched curved condition when subjected to a pressure differential, said membrane having through perforations which are closed in said taut flat condition and which are opened in said stretched curved condition.

5. A container as defined in claim 4, wherein said tube valve means includes a valve body, in the form of a cup, made of flexible, resilient material and including a skirt fitted over the lower end of said tube and a wall extending across the tube open end, said wall having an opening and a partial cutout extending over said opening and integrally depending from a portion of said wall and having a peripheral edge mating with the edge of said opening, said cutout biased into contact with said opening edge.

* * * * *